US006923752B1

(12) United States Patent
Somers et al.

(10) Patent No.: US 6,923,752 B1
(45) Date of Patent: Aug. 2, 2005

(54) FOLDING CYLINDER WITH EXPANSION SEGMENT

(75) Inventors: William Bellis Somers, Rochester, NH (US); Michael Alexander Novick, Cypress, CA (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 09/551,445

(22) Filed: Apr. 18, 2000

(51) Int. Cl.[7] ..... B31B 1/00
(52) U.S. Cl. ..... 493/432; 493/428; 493/424
(58) Field of Search ..... 493/432, 434, 493/429, 428, 424, 471; 492/4, 5, 6, 7; 53/450, 53/550, 578

(56) References Cited

U.S. PATENT DOCUMENTS

| | | | | |
|---|---|---|---|---|
| 2,814,484 A | | 11/1957 | Stobb et al. | 270/43 |
| 5,039,076 A | | 8/1991 | Fischer | 270/47 |
| 5,102,111 A | | 4/1992 | Reponty | |
| 5,122,109 A | * | 6/1992 | Kubota et al. | 493/471 |
| 5,201,701 A | | 4/1993 | Roettger et al. | 493/425 |
| 5,313,883 A | | 5/1994 | DiGenova | 101/247 |
| 5,494,270 A | | 2/1996 | Laubscher | |
| 5,846,177 A | | 12/1998 | Mayr | 493/424 |
| 6,038,974 A | | 3/2000 | Richards | |
| 6,398,704 B1 | * | 6/2002 | Shibuya et al. | 493/424 |

FOREIGN PATENT DOCUMENTS

| | | |
|---|---|---|
| DE | 1132564 | 7/1962 |
| DE | 2309919 | 9/1974 |
| DE | 2530365 | 1/1977 |
| DE | 3906975 | 9/1990 |
| DE | 4103160 | 8/1992 |
| GB | 1003717 | 9/1965 |
| GB | 1426415 | 2/1976 |

* cited by examiner

*Primary Examiner*—Sameh H. Tawfik
(74) *Attorney, Agent, or Firm*—Davidson, Davidson & Kappel, LLC

(57) ABSTRACT

A folding cylinder includes a frame having a work-side support and a gear-side support, at least one expansion segment for providing an effective diameter of the cylinder, the expansion segment being located between the work-side support and the gear-side support and spaced apart from at least one of the work-side support and the gear-side support, and an actuating device for contacting the at least one expansion segment and setting the effective diameter.

16 Claims, 3 Drawing Sheets

FOLDING CYLINDER WITH EXPANSION SEGMENT

BACKGROUND OF THE INVENTION

1. Field of the Invention

The present invention relates generally to folders for printing presses and more particularly to a folding cylinder for a cross-folder.

2. Background Information

Web printing presses print a continuous web of material, such as paper. In a folder of the printing press, the continuous web then is cut into signatures in a cutting unit and folded. One possible fold to the resulting signatures is a cross-fold perpendicular to the direction of movement of the signatures. A tucking cylinder generally will hold a lead edge of a signature with a pin or gripper, either before or after the signature has been cut from the web. A tucking mechanism in the tucking cylinder may then tuck the signature at a mid-point into a jaw of a jaw cylinder or into folding rolls so as to provide a cross-fold.

U.S. Pat. Nos. 5,102,111 and 5,484,270 for example disclose cross-folding folders having tucking cylinders. A web is received between a cutting cylinder and the tucking cylinder to form signatures, the lead edge of the signatures being held by pins. Tucking blades in the cylinders tuck the signatures into jaws of a jaw cylinder.

U.S. Pat. No. 6,038,974, which is not necessarily prior art to the present invention, discloses a cross folder for receiving signatures in grippers. The folder thus could be used with either a web or sheet-fed printing press. A jaw cylinder and tucking cylinder combination provide the cross-fold.

For cutting webs and tucking and transporting signatures, it is often desirable to vary the outer effective diameter of the tucking cylinder to permit proper processing of variable-thickness signatures. Signature width may vary significantly depending on the desired end product. It thus has been known to provide so-called expansion segments on a tucking cylinder, the expansion segments being adjustable by a cam/spring mechanism to vary the effective outer diameter of the tucking cylinder.

However, it has been found that these expansion segments or their supports can be damaged easily, especially during paper jams on one side of the pin cylinder, for example the work side or the gear side.

BRIEF SUMMARY OF THE INVENTION

An object of the present invention is to provide a folding cylinder with an improved expansion segment.

The present invention provides a folding cylinder comprising:

- a frame having a work-side support and a gear-side support;
- at least one expansion segment for providing an effective diameter of the cylinder, the expansion segment being located between the work-side support and the gear-side support and spaced apart from at least one of the work-side support and the gear-side support; and
- an actuating device for contacting the at least one expansion segment and setting the effective diameter.

By being spaced apart from the work-side or gear-side support, space is provided to allow for a non-even depression of the expansion segment in the event of paper jams acting on only one side of the cylinder. Thus, paper jams impacting the expansion segment unevenly need not damage the expansion segment.

The expansion segment preferably includes an outer section and a plurality of J-shaped brackets connected to the outer section. Preferably, a first J-bracket is spaced apart from the work-side support and a second J-bracket is spaced apart from the gear-side support. A third J-bracket may be spaced between the first and second J-brackets.

An end of the J-shaped brackets located opposite the outer section can interact with eccentrics on a camshaft, a rotational angle of the camshaft being adjustable through a worm gear mechanism.

The frame also includes a tie support between the gear-side and work-side supports. Preferably, a plurality of springs on the tie support force the expansion segment radially outwardly. The J-shaped brackets thus may be forced against the eccentrics. By selective rotation of the cam shaft, the effective diameter thus may be set.

Preferably, a space is provided between the expansion segment and the frame both on the gear-side and the work-side. A foam piece preferably is provided in each space, so as to prevent axial movement of the expansion segment except during paper jams. The foam piece most preferably is coated on a frame contact side with a friction-reducing substance, such as TEFLON. The foam piece may be pre-cut to match a profile of a J-bracket and may be pre-applied to the J-bracket by adhesive on an adhesive side opposite the contact side.

The folding cylinder preferably is a pin or pin and tucking cylinder of a cross-folder.

The present invention also provides a method of manufacturing a folding cylinder comprising the steps of:

- providing an expansion segment between a folding cylinder frame having a work and gear side; and
- spacing the expansion segment from the frame so as not to contact the frame.

The method preferably includes placing foam pieces between the expansion segment and the frame.

The terms work-side and gear-side as used herein are for descriptive purposes, and as defined are interchangeable with the terms first and second, respectively.

"Cylinder" as defined herein can be any rotating body.

"Expansion segment" as defined herein is a part of a cylinder which presents itself at an outer section of the cylinder and is adjustable to define an effective diameter of the cylinder.

BRIEF DESCRIPTION OF THE DRAWINGS

A preferred embodiment of the present invention is described below by reference to the following drawings, in which.

DETAILED DESCRIPTION

Figure 1:
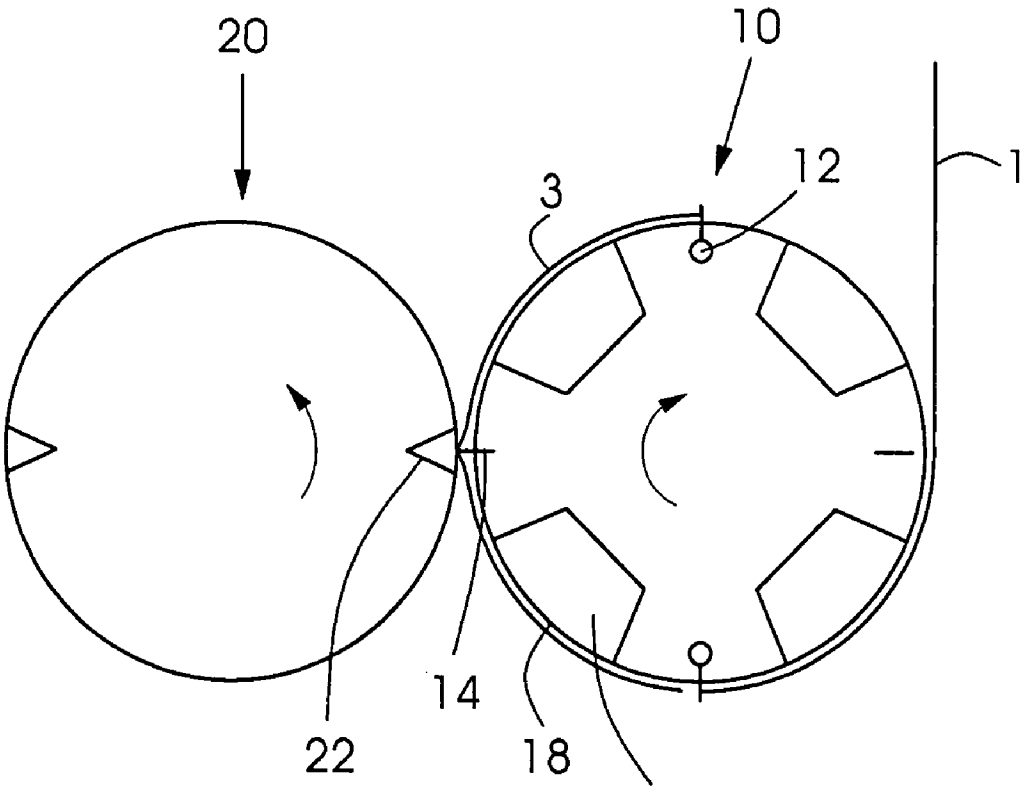
FIG. 1 shows a side view of the folding cylinder of the present invention interacting with a jaw cylinder.

FIG. 1 shows a side view of a schematically-depicted folding cylinder 10 having pins or grippers 12 for holding a lead edge of a web or signature 1. If a web is held, a cutting cylinder interacts with folding cylinder 10 so as form signature 3. Folding cylinder 10 also has tucking blades 14, which can fold signature 3 at a mid-point, as shown. The fold can be accepted by a jaw 22 of a jaw cylinder 20, or could be accepted by a pair of nipping rollers.

Cylinder 10 also includes expansion segments 16 spaced between the pins and tucking blades. An outer surface 18 of segments 16 may define an effective diameter of cylinder 10.

Figure 2:
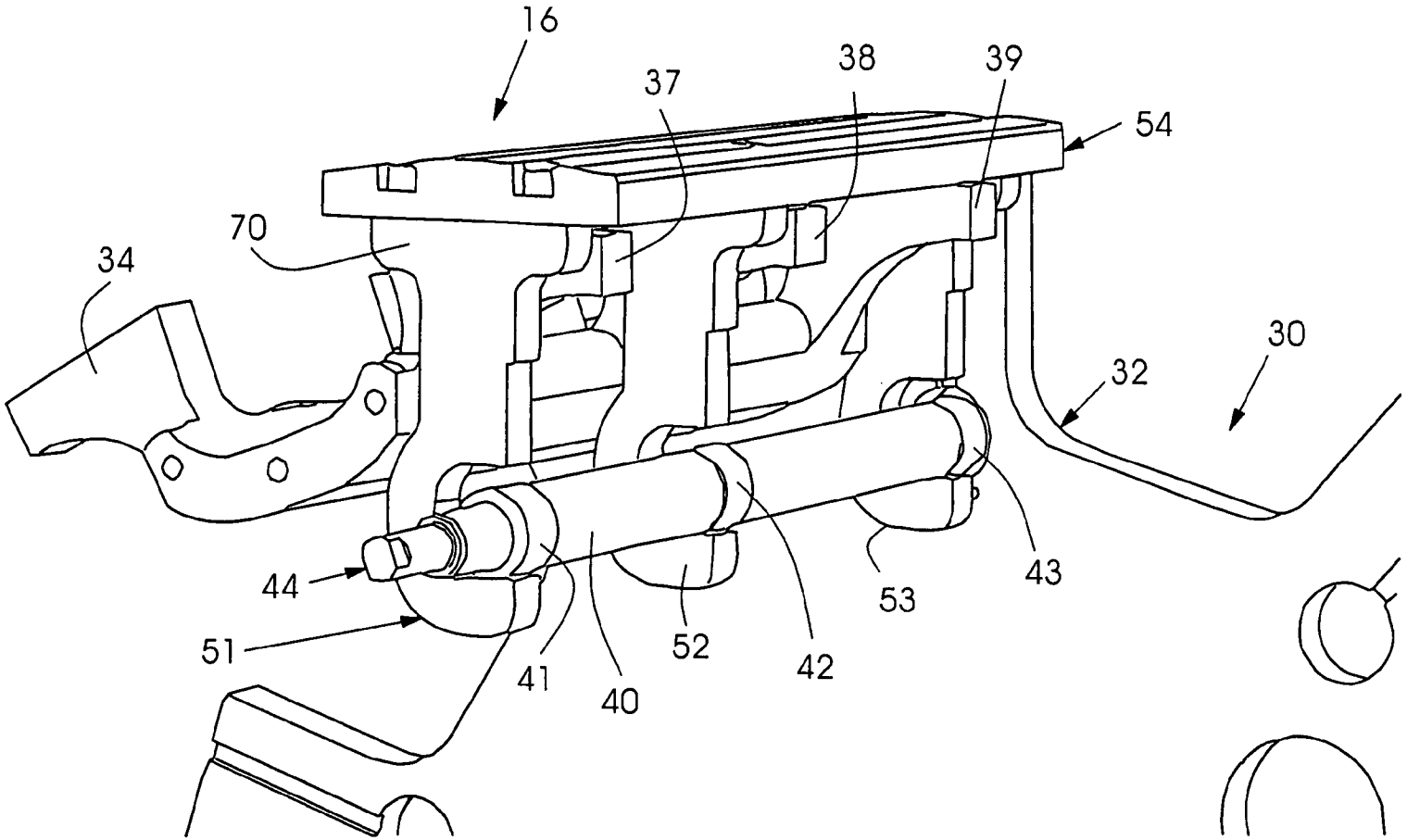
FIG. 2 shows a perspective view of a part of the folding cylinder, with the gear side removed for clarity.
Figure 3:
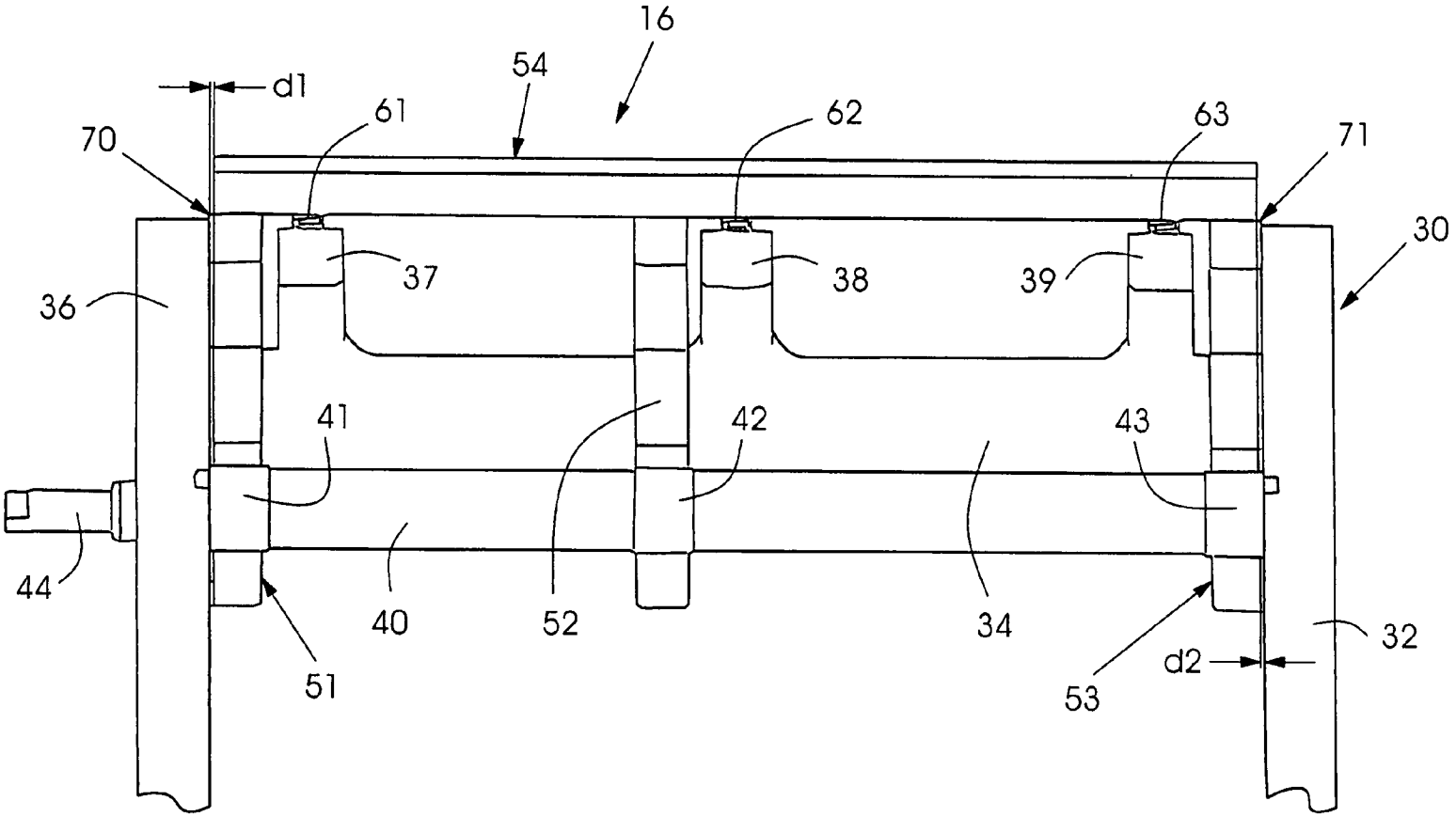
FIG. 3 shows a front view of the part of the cylinder in FIG. 2

Expansion segments 16 are shown in more detail in FIGS. 2 and 3, which show a section of folding cylinder 10 of FIG. 1. A rotating frame 30 of cylinder 10 includes a gear-side support 32, a work-side support 36 and a tie support 34 fixedly connected between the supports 32 and 36. The tie support 34 provides strength to the frame and includes spring support members 37, 38, 39, which preferably are integral with tie support 34.

Supported in gear-side support 32 and work-side support 36 is a camshaft 40 having eccentrics 41, 42, 43. An end 44 of camshaft 40 may be keyed to a worm drive for setting an angular position of camshaft 40 about its axis.

Eccentrics 41, 42, 43 interact with J-brackets 51, 52, 53 respectively of expansion segment 16. J-brackets 51, 52, 53 are fixedly connected to an outer section 54 of expansion segment 16. On a radially-inward side of outer section 54 are a plurality of springs 61, 62, 63, supported as well by spring support members 37, 38, 39, respectively. It should be understood that more springs may be provided along these spring support members 37, 38, 39 (e.g. into the paper in FIG. 3).

Expansion segment 16 thus is forced radially outwardly with respect to frame 30 by the action of springs 61, 62, 63, but is retained by the interaction of J-brackets 51, 52, 53 against eccentrics 41, 42, 43.

The selective rotation of camshaft 40 can change the eccentric angle, so that the eccentrics permit J-brackets 51, 52, 53 and outer section 54 to move radially inwardly or outwardly. An effective outer diameter of cylinder 10 thus may be set.

With the present invention, J-bracket 51 is spaced a distance d1 apart from work-side support 36, and J-bracket 53 is spaced a distance d2 apart from gear-side support 32.

Foam pieces 70, 71 may fit into these spaces to prevent contact between the respective parts. Foam pieces 70, 71 may be pre-cut to match a J-bracket profile and then are applied with pressure-sensitive adhesive to the J-brackets, with a friction-reducing coating being located on the contact surface with supports 36, 32, respectively. However, the foam and any friction-reducing coating may also be pre-applied to a side of the J-brackets, for example through spraying. The friction-reducing coating helps permit adjustment of expansion segment 16 and preferably is made of TEFLON.

The spacing d1, d2 permits segment 16 to slightly move in the event that a paper jam or other obstruction depresses segment 16 unevenly. For example, if a wad of paper or mill splice passes through a pin-jaw cylinder interface only near the work-side support 36, spring 61 compresses, while spring 63 does not. Due to distances d1, d2, the expansion segment 16 can rotate slightly without damage to the expansion segment 16, compressing the upper part of foam piece 70 and the lower end of foam piece 71. Once the obstruction passes, expansion segment 16 can return to its normal position.

The spacings or distances d1 and d2 may be, for example, 2 mm. The foam, which is compressible, helps keep the spacings free of dust, paper and grease.

What is claimed is:

1. A folding cylinder comprising:

a frame having a work-side support and a gear-side support;

at least one expansion segment for providing an effective diameter of the cylinder, the expansion segment being located between the work-side support and the gear-side support and spaced apart from at least one of the work-side support and the gear-side support, the expansion segment being movable so as to be non-evenly depressible over a width of the expansion segment; and an actuating device for contacting the at least one expansion segment and setting the effective diameter.

2. The folding cylinder as recited in claim 1 wherein the at least one expansion segment is spaced-apart from both the work-side support and the gear-side support.

3. The folding cylinder as recited in claim 1 wherein the expansion segment includes an outer section and a plurality of J-shaped brackets connected to the outer section, a first J-bracket being spaced apart from the work-side support and a second J-bracket being spaced apart from the gear-side support.

4. The folding cylinder as recited in claim 3 wherein an end of the J-shaped brackets located opposite the outer section interacts with eccentrics on a camshaft, a rotational angle of the camshaft being adjustable.

5. The folding cylinder as recited in claim 1 wherein the frame includes a tie support between the gear-side and work-side supports, and further comprising a plurality of springs on the tie support for forcing the expansion segment radially outwardly.

6. The folding cylinder as recited in claim 1 further comprising a foam piece in a space between the expansion segment and the at least one of the gear-side and work side supports.

7. The folding cylinder as recited in claim 2 further comprising foam pieces between the expansion segment and the work-side support and between the expansion segment and the gear side support.

8. The folding cylinder as recited in claim 3 further comprising a foam piece attached to a side of the first J-bracket.

9. The folding cylinder as recited in claim 8 wherein the foam piece entirely covers the side of the first J-bracket in its entirety.

10. The folding cylinder as recited in claim 6 wherein the foam piece includes a friction-reducing coating.

11. The folding cylinder as recited in claim 1 wherein the cylinder is a pin cylinder of a cross-folder.

12. A folding cylinder comprising:

a frame having a work-side support and a gear-side support;

at least one expansion segment for providing an effective diameter of the cylinder, the expansion segment being located between the work-side support and the gear-side support and spaced apart from at least one of the work-side support and the gear-side support;

a foam piece having at least one friction-reducing surface in a space between the expansion segment and the at least one of the gear-side and work-side supports; and an actuating device for contacting the at least one expansion segment and setting the effective diameter.

13. The folding cylinder as recited in claim 12 wherein the foam piece has an adhesive located on a side opposite the friction-reducing surface.

14. The folding cylinder as recited in claim 12 wherein the foam piece is fixed with respect to the expansion segment and movable with respect to the at least one of the gear-side and work-side supports.

15. The folding cylinder as recited in claim 12 wherein the foam piece includes a friction-reducing coating so as to create the friction-reducing surface.

16. A folding cylinder comprising:

a frame having a work-side support and a gear-side support;

at least one expansion segment for providing an effective diameter of the cylinder, the expansion segment being located between the work-side support and the gear-side support;

a first foam piece having at least one friction-reducing surface in a space between the expansion segment and the gear-side support;

a second foam piece having at least one friction-reducing surface in a space between the expansion segment and the work-side support; and an actuating device for contacting the at least one expansion segment and setting the effective diameter.

* * * * *